US009066187B2

(12) United States Patent
van Halteren

(10) Patent No.: US 9,066,187 B2
(45) Date of Patent: Jun. 23, 2015

(54) DUAL TRANSDUCER WITH SHARED DIAPHRAGM

(71) Applicant: Sonion Nederland BV, Hoofddorp (NL)

(72) Inventor: Aart Zeger van Halteren, Hobrede (NL)

(73) Assignee: Sonion Nederland BV, Hoofddorp (NL)

( * ) Notice: Subject to any disclaimer, the term of this patent is extended or adjusted under 35 U.S.C. 154(b) by 0 days.

(21) Appl. No.: 14/057,101

(22) Filed: Oct. 18, 2013

(65) Prior Publication Data

US 2014/0112507 A1 Apr. 24, 2014

Related U.S. Application Data

(60) Provisional application No. 61/715,690, filed on Oct. 18, 2012.

(51) Int. Cl.
*H04R 25/00* (2006.01)
*H04R 1/32* (2006.01)
*H04R 1/40* (2006.01)

(52) U.S. Cl.
CPC ..... *H04R 25/40* (2013.01); *H04R 1/326* (2013.01); *H04R 1/406* (2013.01); *H04R 25/405* (2013.01)

(58) Field of Classification Search
CPC ..... H04R 2440/00–2440/07; H04R 1/08; H04R 9/08; H04R 11/04; H04R 17/02; H04R 21/02; H04R 19/04; H04R 19/005; H04R 1/00; H04R 2205/022; H04R 2201/401; H04R 2201/405; H04R 2217/00–2217/03; H04R 19/00–19/01; H04R 19/013; H04R 19/016; H04R 7/04
USPC ..... 381/152, 171, 173–175, 182, 190–191, 381/431
See application file for complete search history.

(56) References Cited

U.S. PATENT DOCUMENTS

| | | | | |
|---|---|---|---|---|
| 6,782,109 | B2 * | 8/2004 | Sheplak et al. | 381/152 |
| 6,788,796 | B1 | 9/2004 | Miles et al. | |
| 6,831,577 | B1 | 12/2004 | Furst | |
| 6,853,290 | B2 | 2/2005 | Jorgensen et al. | |
| 6,859,542 | B2 | 2/2005 | Johannsen et al. | |
| 6,888,408 | B2 | 5/2005 | Furst et al. | |
| 6,914,992 | B1 | 7/2005 | van Halteren et al. | |
| 6,919,519 | B2 | 7/2005 | Ravnkilde et al. | |
| 6,930,259 | B1 | 8/2005 | Jorgensen et al. | |
| 6,943,308 | B2 | 9/2005 | Ravnkilde et al. | |
| 6,974,921 | B2 | 12/2005 | Jorgensen et al. | |
| 7,008,271 | B2 | 3/2006 | Jorgensen | |
| 7,012,200 | B2 | 3/2006 | Moller | |
| 7,062,058 | B2 | 6/2006 | Steeman et al. | |
| 7,062,063 | B2 | 6/2006 | Hansen et al. | |
| 7,072,482 | B2 | 7/2006 | Van Doorn et al. | |

(Continued)

FOREIGN PATENT DOCUMENTS

DE 10 2010 02115 11/2011

OTHER PUBLICATIONS

European Search Report, European Application No. EP 13 18 9277, dated Mar. 19, 2015, 3 pages.

*Primary Examiner* — Suhan Ni
(74) *Attorney, Agent, or Firm* — Nixon Peabody LLP

(57) ABSTRACT

The invention relates to a transducer comprising a housing having a first and a second sound input, a first and a second vibration sensors configured to convert vibration to an output, and a diaphragm connected to both the first and second vibration sensor.

19 Claims, 2 Drawing Sheets

(56) References Cited

U.S. PATENT DOCUMENTS

| | | | |
|---|---|---|---|
| 7,088,839 | B2 | 8/2006 | Geschiere et al. |
| 7,110,560 | B2 | 9/2006 | Stenberg |
| 7,136,496 | B2 | 11/2006 | van Halteren et al. |
| 7,142,682 | B2 | 11/2006 | Mullenborn et al. |
| 7,181,035 | B2 | 2/2007 | van Halteren et al. |
| 7,190,803 | B2 | 3/2007 | van Halteren |
| 7,206,428 | B2 | 4/2007 | Geschiere et al. |
| 7,221,767 | B2 | 5/2007 | Mullenborn et al. |
| 7,221,769 | B1 | 5/2007 | Jorgensen |
| 7,227,968 | B2 | 6/2007 | van Halteren et al. |
| 7,239,714 | B2 | 7/2007 | de Blok et al. |
| 7,245,734 | B2 | 7/2007 | Niederdraenk |
| 7,254,248 | B2 | 8/2007 | Johannsen et al. |
| 7,286,680 | B2 | 10/2007 | Steeman et al. |
| 7,292,700 | B1 | 11/2007 | Engbert et al. |
| 7,292,876 | B2 | 11/2007 | Bosch et al. |
| 7,336,794 | B2 | 2/2008 | Furst et al. |
| 7,376,240 | B2 | 5/2008 | Hansen et al. |
| 7,403,630 | B2 | 7/2008 | Jorgensen et al. |
| 7,415,121 | B2 | 8/2008 | Mögelin et al. |
| 7,425,196 | B2 | 9/2008 | Jorgensen et al. |
| 7,460,681 | B2 | 12/2008 | Geschiere et al. |
| 7,466,835 | B2 | 12/2008 | Stenberg et al. |
| 7,492,919 | B2 | 2/2009 | Engbert et al. |
| 7,548,626 | B2 | 6/2009 | Stenberg et al. |
| 7,657,048 | B2 | 2/2010 | van Halteren et al. |
| 7,684,575 | B2 | 3/2010 | van Halteren et al. |
| 7,706,561 | B2 | 4/2010 | Wilmink et al. |
| 7,715,583 | B2 | 5/2010 | Van Halteren et al. |
| 7,728,237 | B2 | 6/2010 | Pedersen et al. |
| 7,809,151 | B2 | 10/2010 | Van Halteren et al. |
| 7,822,218 | B2 | 10/2010 | Van Halteren |
| 7,899,203 | B2 | 3/2011 | Van Halteren et al. |
| 7,912,240 | B2 | 3/2011 | Madaffari et al. |
| 7,946,890 | B1 | 5/2011 | Bondo et al. |
| 7,953,241 | B2 | 5/2011 | Jorgensen et al. |
| 7,961,899 | B2 | 6/2011 | Van Halteren et al. |
| 7,970,161 | B2 | 6/2011 | van Halteren |
| 8,098,854 | B2 | 1/2012 | van Halteren et al. |
| 8,101,876 | B2 | 1/2012 | Andreasen et al. |
| 8,103,039 | B2 | 1/2012 | van Halteren et al. |
| 8,160,290 | B2 | 4/2012 | Jorgensen et al. |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman et al. |
| 8,233,652 | B2 | 7/2012 | Jorgensen et al. |
| 8,259,963 | B2 | 9/2012 | Stenberg et al. |
| 8,259,976 | B2 | 9/2012 | van Halteren |
| 8,259,977 | B2 | 9/2012 | Jorgensen et al. |
| 8,280,082 | B2 | 10/2012 | van Halteren et al. |
| 8,284,966 | B2 | 10/2012 | Wilk et al. |
| 8,313,336 | B2 | 11/2012 | Bondo et al. |
| 8,315,422 | B2 | 11/2012 | van Halteren et al. |
| 8,331,595 | B2 | 12/2012 | van Halteren |
| 8,369,552 | B2 | 2/2013 | Engbert et al. |
| 8,379,899 | B2 | 2/2013 | van Halteren et al. |
| 8,509,468 | B2 | 8/2013 | van Halteren et al. |
| 8,526,651 | B2 | 9/2013 | Lafort et al. |
| 8,526,652 | B2 | 9/2013 | Ambrose et al. |
| 2009/0214062 | A1 | 8/2009 | Reining |
| 2011/0182453 | A1 | 7/2011 | van Hal et al. |
| 2011/0189880 | A1 | 8/2011 | Bondo et al. |
| 2011/0299708 | A1 | 12/2011 | Bondo et al. |
| 2011/0299712 | A1 | 12/2011 | Bondo et al. |
| 2011/0311069 | A1 | 12/2011 | Ambrose et al. |
| 2012/0014548 | A1 | 1/2012 | van Halteren |
| 2012/0027245 | A1 | 2/2012 | van Halteren et al. |
| 2012/0140966 | A1 | 6/2012 | Mocking et al. |
| 2012/0155683 | A1 | 6/2012 | van Halteren |
| 2012/0155694 | A1 | 6/2012 | Reeuwijk et al. |
| 2012/0255805 | A1 | 10/2012 | van Halteren et al. |
| 2013/0028451 | A1 | 1/2013 | de Roo |
| 2013/0136284 | A1 | 5/2013 | van Hal et al. |
| 2013/0142370 | A1 | 6/2013 | Engbert et al. |
| 2013/0163799 | A1 | 6/2013 | van Halteren |
| 2013/0195295 | A1 | 8/2013 | van Halteren et al. |

* cited by examiner

DUAL TRANSDUCER WITH SHARED DIAPHRAGM

REFERENCE TO RELATED APPLICATIONS

This application claims the benefit of U.S. Provisional Patent Application Ser. No. 61/715,690, filed Oct. 18, 2012, and titled "Transducer, A Hearing Aid Comprising The Transducer And A Method Of Operating The Transducer," which is incorporated by reference herein its entirety.

FIELD OF THE INVENTION

The present invention relates to a dual transducer, such as a dual microphone, such as a directional microphone, having two vibration or sound sensors sharing the same diaphragm.

BACKGROUND OF THE INVENTION

Current directional microphones for hearing aids are made by matching a pair of microphones on phase and amplitude with a certain accuracy and specification. The main problem is drift after the matching. One of the major reasons for drift is changes in membrane tension. Both membranes will never age in the same way.

The technical problems of the state of the art are to control long and short term drift of the microphones. For short term drift due to say humidity, temperature etc. materials may be selected which have low drift coefficients. For longer term drift, other materials may be required, as any plastic material will have aging problems.

One prior art solution, naturally is the pairing of neighbouring membranes in a production matrix. This, however, has been found insufficient.

SUMMARY OF THE INVENTION

In a first aspect, the invention relates to a transducer comprising a housing having a first and a second sound input and comprises therein:

- a first and a second vibration sensors configured to convert vibration to an output,
- a diaphragm connected to both the first and second vibration sensor, wherein:

- a first chamber is delimited at least partly by a first part of the housing and a first part of the diaphragm, the first vibration sensor being configured to detect vibration of the first part of the diaphragm, the first sound input opening into the first chamber,
- a second chamber is delimited at least partly by a second part of the housing and a second part of the diaphragm, the second vibration sensor being configured to detect vibration of the second part of the diaphragm, the second sound input opening into the second chamber.

In this context, a transducer usually is an element configured to convert sound to a signal, such as an electrical, optical and/or wireless signal or vice versa.

The present transducer may be a so-called miniature transducer, which usually has outer dimensions of less than about 3.5×3.5 mm×1.3 mm (w×l×h). Many miniature transducers occupy a volume less than 13 $mm^3$.

The housing may have any shape but usually is rectangular and has rounded corners and edges. The housing walls usually are each made by a single layer of a material, such as a metal, alloy, polymer, rubber, plastic or the like.

The first and second sound inputs are separate inputs each opening into a separate chamber. Usually, the sound inlets are dimensioned to allow sound within the audible frequency range of 20-20,000 Hz to enter the chambers with no substantial attenuation. Preferably, the first and second sound inlets have the same dimensions.

Vibration sensors are widely used in, for example, the hearing aid industry. Such sensors may be based on a number of different technologies, such as the electret principle, moving magnet, moving coil, moving armature, or the like. The first and second vibration sensors may be based on the same technology or not. In a preferred embodiment, the first and second vibration sensors are based on the same technology and are desired as identical as possible.

The vibration sensors are configured to or adapted to convert vibration into an output which usually is electrical but which may also be optical or wireless.

The diaphragm is preferably a single, monolithic element which may be a polymer or plastic sheet or layer. On this layer, electrically conductive layers may be provided if desired, such as for use in the below described electret set-ups.

Thus, when both vibration sensors are connected to the same diaphragm, less difference in diaphragm tension drift can occur over time between the vibration sensors. When the transducer is a dual microphone, the two microphones will remain matched independently of any diaphragm tension drift.

The diaphragm is connected to the first and second vibration sensors so that vibration of the diaphragm will affect the output of the vibration sensors. In this context it is noted that the connection need not be a mechanical connection, as is usually desired in moving coil/magnet/armature set-ups. In electret set-ups, a distance variation between the diaphragm and a back plate will generate the output signal, and in this situation, no mechanical connection exists; in this case the connection is functional.

The first and second chambers are provided inside the housing and are both delimited by parts of the housing and of the diaphragm.

The first and second chambers preferably are separate and have no common volume inside the housing. Thus, the first and second parts of the diaphragm preferably are non-overlapping.

Nevertheless, both vibration sensors are connected to the same diaphragm but to different parts thereof, which parts form part of a surface of different chambers having different sound inputs.

Naturally, additional elements may be provided inside the first and second chambers and thus take part in the delimiting thereof or forming a part of an inner surface thereof.

In a preferred embodiment, the housing comprises a dividing portion which extends between the first and second chambers and which forms part of the first and second parts of the housing. One manner of obtaining this is to have an element extend between the first and second chambers and having two opposing sides or surfaces, one of which takes part in the delimiting of one of the chambers and the other taking part in the delimiting of the other chamber.

In this situation, the dividing portion may engage the diaphragm between the first and second parts of the diaphragm. This may be in order to prevent sound from travelling between the diaphragm and the dividing portion from one chamber to the other chamber. This engagement preferably is not a fixation in that it is desired that the diaphragm is allowed or able move in relation to the dividing portion. Thus, preferably, the dividing portion engages a portion of the diaphragm, the diaphragm portion being movable in relation to the dividing portion.

To allow the diaphragm to move in relation to the dividing portion, an opening may exist between the diaphragm and the dividing portion. This opening may be an oblong opening, whereby the dividing portion does not engage or touch the diaphragm or may be provided as a number of separate openings spaced apart by ridges or bumps which contact the diaphragm.

Preferably, the opening or openings having dimensions which allow gas flow from the first to the second chamber, but which do not allow transmission of sound there through from the first to the second chamber.

Preferably, an opening has an area, when projected on to a plane perpendicular to a direction of the gas flow from the first to the second chamber, of between 3 and 30,000 $\mu m^2$ such between 300 and 30,000 $\mu m^2$.

An alternative or addition to the opening(s) is to have the diaphragm attached to the dividing portion via a resilient element. Preferably, the resilient element is deformable in a direction from the first chamber to the second chamber so that if one part of the diaphragm contracts, other parts of the diaphragm are allowed, also by the resilient element, to expand and thus move in the direction from one of the chambers to the other of the chambers.

Technically, the diaphragm may then be divided into two portions which are attached to each other and/or to the resilient element so that contraction of one will make the other extend and in this process deform the resilient element to allow this shape change.

This resilient element may be made of a polymer, a foam, a plastics material, a rubber, a glue material which does not harden fully, or the like. The resilient element may have any shape or cross section but preferably has a resiliency that is lower than the resiliency of the diaphragm. A suitable material may be fluoro-gel or silicone gel.

An alternative to the resilient element and the dividing portion is to have the dividing portion engage the diaphragm, but itself be able to be deformed or bent, such as if the dividing portion is made of a resilient or bendable material or has a deformable material allowing the part of the dividing portion follow the translation of the part of the diaphragm to which it is attached while allowing another portion of the dividing portion remain fixed to the housing, for example.

It may be desired to have an even or constant contact between the dividing portion and the diaphragm. Thus, it may be desired to have the diaphragm biased toward the dividing portion. This biasing may be obtained by suitable dimensioning of the dividing portion in relation to the position of the diaphragm if the dividing portion was left out.

In order to allow the diaphragm to move in relation to the dividing portion, it is preferred that the dividing portion has a rounded surface engaging the diaphragm.

In a preferred embodiment, the diaphragm is fixed to the housing on at least a first and a second side of the diaphragm. The first side is fixed at a part of the first part of the housing. The second side is fixed at a part of the second part of the housing. The first and second parts of the diaphragm are positioned between the first and second sides of the diaphragm. In this manner, if the second part contracts, the first part may expand, without the attachment to the housing preventing this adaptation.

The first and second sides preferably are fixed at outer sides of the first and second chambers so that most of or preferably all of the first and second parts of the diaphragm are positioned between the first and second sides.

If the diaphragm is elongate, the attachment may be at the shorter sides thereof and only partly (or not at all) along the longer sides thereof.

In one situation, the diaphragm is at least substantially rectangular with two shorter and two longer sides. The first and second sides are the two shorter sides. The diaphragm is being detached from the housing over at least a majority of the length of the longer sides. Preferably, the diaphragm is not fixed to the housing at the centre or interface between the first and second parts of the diaphragm.

The diaphragm may be fixed, along the longer sides, along no more than 20%, such as no more than 10%, such as no more than 5% of the length of a longer side.

As mentioned above, a preferred type of vibration sensor is an electret type of sensor. For such sensors, each of the first and second parts of the diaphragm is preferably electrically conducting and wherein the first and second parts are electrically isolated from each other. This electrical insulation separates the two parts so that each part separately may be used in a vibration sensor.

In this situation, the vibration sensors may in one embodiment comprise an electrically conducting element positioned in the vicinity of the first and second parts of the diaphragm and may be configured to output signals corresponding to a distance between the first and second parts, respectively, and the conducting element. Thus, the two vibration sensors may have a common conducting element, such as a common back plate.

In another embodiment, the first vibration sensor comprises a first electrically conducting element positioned in the vicinity of the first part of the diaphragm and is configured to output a first signal corresponding to a distance between the first part and the first conducting element. The second vibration sensor comprises a second electrically conducting element positioned in the vicinity of the second part of the diaphragm and is configured to output a second signal corresponding to a distance between the second part and the second conducting element. The vibration sensors in this embodiment have separate conducting elements and thus separate back plates.

Naturally, the transducer may have separate back chambers as it has separate front chambers. Thus, the transducer may further have a third and a fourth chamber. The third chamber is delimited at least partly by a third part of the housing and a first surface of the first part of the diaphragm, a second surface, opposite to the first surface, of the first part taking part in the delimiting of the first chamber. The fourth chamber is delimited at least partly by a fourth part of the housing and a first side of the second part of the diaphragm, a second side, opposite to the first side, of the second part taking part in the delimiting of the second chamber.

The first and second sides of the diaphragm thus take part in defining corresponding front and back chambers.

An alternative to separate back chambers is a common back chamber which may be obtained when the transducer has a common chamber delimited at least partly by a first surface of the diaphragm, a second surface, opposite side of the diaphragm taking part in the definition of the first and second chambers.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and best modes for carrying out the present invention when taken in connection with the accompanying drawings and the appended claims.

BRIEF DESCRIPTION OF THE DRAWINGS

In the following, preferred embodiments will be described with reference to the drawing, wherein.

Figure 1:
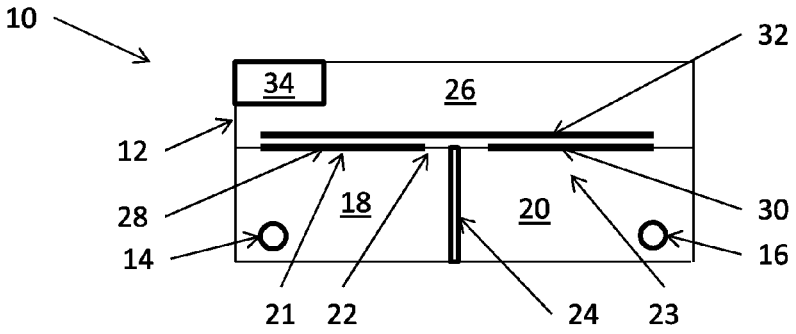
FIG. 1 illustrates a first embodiment of a transducer according to the invention.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE DRAWINGS

In FIG. 1, a transducer 10 is seen having a housing 12 having a first sound opening 14 and a second sound opening 16 opening into a first chamber 18 and a second chamber 20. The first chamber 18 and the second chamber 20 are defined by inner surfaces of the housing 12, a dividing wall 24, and respective parts 21 and 23 of a diaphragm 22.

In the housing 12, a further chamber, 26, is defined by the upper side of the diaphragm 22 and inner surfaces of the housing 12.

The diaphragm 22 has two electrically conducting areas 28, 30 positioned in the parts of the diaphragm 22 defining portions of the surfaces of the chambers 18 and 20, respectively. The conducting areas 28, 30 may be positioned on either (upper or lower) side of the diaphragm 22. In addition, an electrically conducting element 32 is provided positioned in the chamber 26 and in the vicinity of the conducting areas 28, 30.

The operation of the transducer 10 is that sound enters the inputs 14, 16 and vibrates the two parts 21, 23 of the diaphragm 22 defining part of the chambers 18 and 20. This vibration causes a distance difference between the conducting areas 28 and 30, respectively, and the conducting element 32, which may be used as a back plate in a standard electret set-up which is configured to output a signal corresponding to the distance between the conducting areas 28, 30, respectively, and the element 32. The variation in this distance will relate to the vibration of the parts 21 and 23 of the diaphragm 22 and, thus, the frequency contents and amplitude of the sound received. Thus, each part 21 and 23 of the diaphragm 22 has a vibration sensor.

In an alternative embodiment, the conducting element 32 may have, at the centre thereof, an electrical isolation so that the parts of the conducting element 32 that are closest to the conducting areas 28, 30 are conducting, but electrically isolated from each other. As such, in spite of the use of the common conducting element 32, the two vibration sensors are electrically isolated from each other.

Electronics 34 may be provided for receiving the outputs of the two vibration sensors and for generating a combined output or to provide separate outputs.

In one situation, the transducer 10 may be used as a standard directional microphone so that the signals from the two vibration sensors are combined, and at least one of the signals is, for example, time delayed or phase shifted in order to generate an output signal. In another situation, the transducer 10 may be used as an omni-directional microphone, so that the signals from the two vibration sensors are combined as a summed omni-directional output signal.

The one of the functions of the dividing wall 24 is to ensure that the chambers 18 and 20 may function independently of each other. As such, sound entering into the chamber 18 will not, via the wall 24, provide sound or vibration (to any significant degree) to the other chamber 20, and vice versa.

Figure 2:
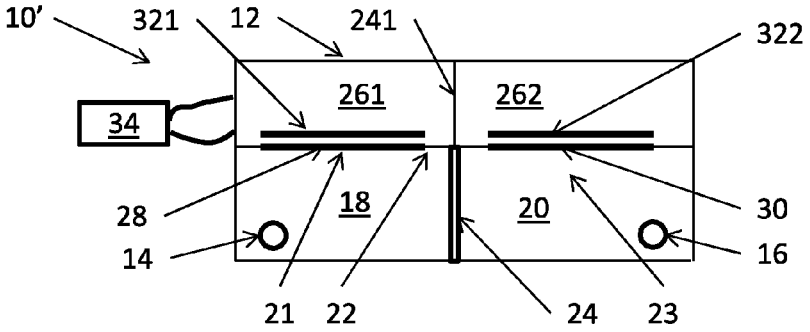
FIG. 2 illustrates a second embodiment of a transducer according to the invention.

In FIG. 2, another embodiment of a transducer 10' is illustrated which differs from that of FIG. 1 in that the electronics 34 are now provided outside the housing 12 and that the chamber 26 of FIG. 1 has been replaced by two chambers 261 and 262 divided by a second dividing wall 241. The single conducting element 32 of FIG. 1 has been replaced by two elements 321 and 322, respectively. The operation of the vibration sensors may be as that of FIG. 1, or the operation may be reversed as the signal may now also be derived from the elements 321 and 322 which are not shared between the two vibration sensors.

The dividing wall 241 is positioned so as to be close to or engage the diaphragm 22 at the centre thereof, whereas the dividing wall 24 engages or is close to the diaphragm 22 in order to not have vibrations from any of the parts 21, 23 enter the other chamber 261, 262.

The signals output to and the treatment thereof in the electronics 34 may be the same.

However, it is noted that the diaphragm 22 is generally not fixed to the dividing wall 24 and, thus, may move in relation thereto, so that the tension of the parts 21 and 23 may be at least substantially the same. However, it is desired that the chambers 18 and 20 are acoustically separated, or at least that substantially no acoustic signals enter the chamber 20 from the chamber 18 via the dividing wall 24.

Figures 3A, 3B, 3C:
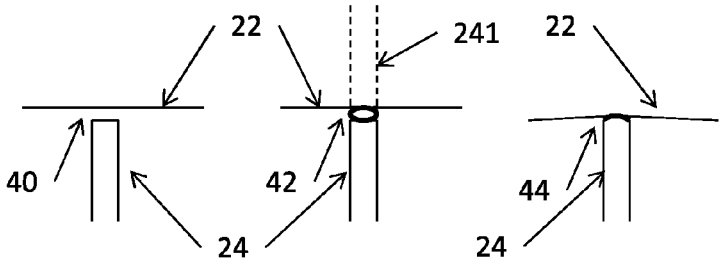
FIGS. 3A, 3B, and 3C illustrate different types of engagement and the like between the dividing wall and the diaphragm.

In FIGS. 3A-3B, different manners of obtaining the combination of the acoustic separation and the ability of the diaphragm 22 to move in relation to the dividing wall 24 are illustrated.

In FIG. 3A, an opening 40 is allowed between the dividing wall 24 and the diaphragm 22. This opening 40 is selected with a dimension sufficiently small for it to not guide a significant amount or amplitude of sound in the audible range (20-20,000 Hz). In one situation, this opening 40 may have an overall area corresponding to a circular vent with a diameter of between 3 and 100 μm such between 3 and 30 μm or even more preferably between 3 and 20 μm. Consequently, even though the dividing wall 24 does not touch or engage the diaphragm 22, the wall 24 provides an acoustical seal between the chambers 18 and 20.

In FIG. 3B, another solution is seen wherein a soft material 42, such as a gel, a polymer, rubber, soft plastics or the like is provided as a part of the wall 24 and which engages the diaphragm 22 in a manner so as to be deformable when the diaphragm moves left-right in the drawing (either the diaphragm material at part 21 expands more than the diaphragm material at part 23 or vice versa). Usually, the major part of the wall will, in order to maintain its function and prevent audio transport across the wall 24, be stiff such as when the wall 24 is made of metal or hard plastics/polymer.

The height (in the drawing) and/or resilience of the material 42 may be adapted so as to not interfere significantly with the operation of the diaphragm 22 when this expands/contracts and therefore deforms the top part of the material 42 to the left or the right.

Alternatively, the wall 24 may be provided with, along the interface between the wall 24 and the diaphragm 22, bumps or projections contacting or engaging the diaphragm 22, while valleys therebetween do not contract or engage the diaphragm 22. This gives a vague controlling of the position and engagement between the wall 24 and the diaphragm 22 while allowing gas flow between the chambers 28/30.

In FIG. 3C, another manner of establishing acoustical separation using the wall 24 is illustrated in which the diaphragm 22 is slightly bent by being biased downwardly toward the wall 24 which, in order to allow the diaphragm 22 to slide there over in spite of the biasing, may have a rounded upper edge 44.

It should be noted that the other dividing wall 241 (FIG. 2) is also illustrated in FIG. 3B. Naturally, this wall 241 may have the same overall purpose, i.e. to provide an acoustical separation between the chambers 261 and 262. This wall 241, then, may have the same relationship vis-à-vis the diaphragm 22. Naturally, the walls 24 and 241 may have different solutions, so that one wall may have an opening as illustrated in FIG. 3A and the other a soft material as seen in FIG. 3B.

Figure 4:
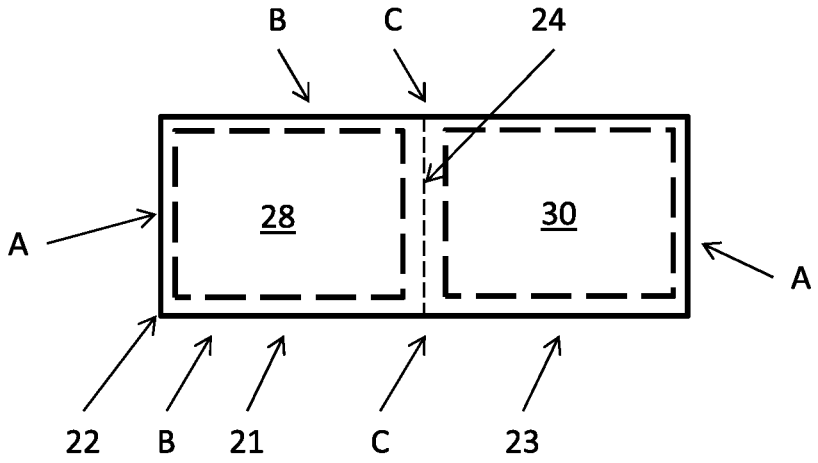
FIG. 4 illustrates the preferred mounting of the diaphragm.

In FIG. 4, the mounting or suspension of the diaphragm 22 is illustrated in an embodiment where the diaphragm is rectangular with two shorter sides "A" and two longer sides "B." The areas 28, 30 and the parts 21, 23 are also illustrated, as is the position of the wall 24, which may or may not touch or engage the diaphragm 22.

When the diaphragm 22 contracts and expands, it is desired that, in order for it to be able to even out during this deformation, it is not fixed at the portions around the position of the wall 24. This position is indicated at "C".

In one embodiment, the diaphragm 22 is only fixed to the housing 12 at the shorter sides "A." Then, acoustic sealing along the sides "B" between the housing 12 and the diaphragm 22 may be obtained using any of the manners described in relation to FIG. 3.

In another embodiment, the diaphragm may be fixed to the housing 12 also at a part of the longer sides "B," such as a predetermined percentage of the distance from the corners to the centre "C," starting at the corners. This percentage may be 5% or less, such as 10% or less, such as 15% or less, such as 20% or less, such as 25% or less, such as 30% or less, such as 35% or less, such as 50% or less, such as 60% or less, such as 70% or less, such as 80% or less, such as 90% or less.

From FIG. 4, it is also seen that an area is provided between the areas 28, 30 which is electrically insulating so as to separate the areas 28, 30 and thus the vibration sensors.

Also, using this type of vibration sensor, it is possible to adjust distance between the diaphragm 22, i.e., the areas 28, 30, and the conducting elements 32, 321, 322 to adjust the sensitivity of the vibration sensor. The conducting elements 32, 321, 322 may be fixed in any situation in relation to the diaphragm using e.g. glue, soldering, welding or the like.

Naturally, the electret set-ups may be replaced by other types of vibration sensors, such as moving coil or moving magnet set-ups where the moving magnet/coil is attached to the part 21/23, such as via a drive pin.

It is preferred that the vibration sensors relating to the two areas 21, 23 are of the same type, but this is not a requirement.

Additionally, and especially in the situation of directional microphones, it is desired that the chambers 18 and 20 have the same size and that the areas 21, 23 have the same size and dimension, but especially for other situations, these may be varied in order to provide two transducers with different capabilities and properties.

Figure 5:
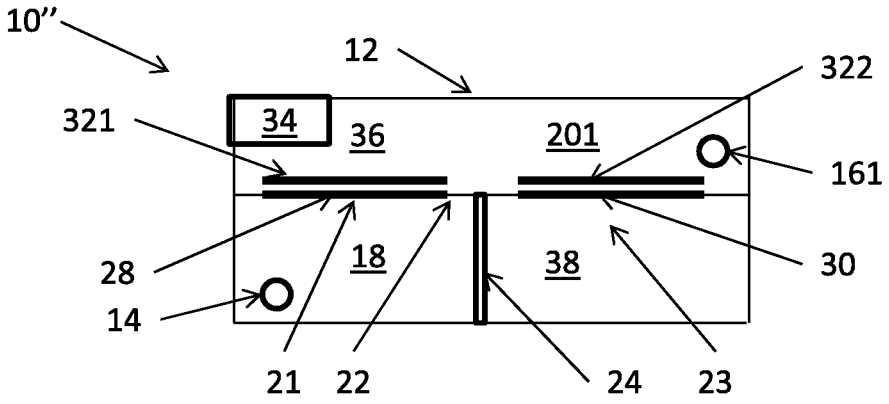
FIG. 5 illustrates a third embodiment of a transducer according to the invention.

Actually, when an amplifier circuit is provided for each vibration sensor, such as an integrated circuit (IC) connected to a PCB, such circuits are usually slightly different. This difference, however, may be compensated for by altering a distance between the back plate and the conductive diaphragm parts. In FIG. 5, another embodiment of a transducer 10" is illustrated which differs from that of FIG. 1 in that the second sound opening 161 is now opening into second chamber 201 now defined on another side of the diaphragm 22. The transducer 10" having the housing 12 further has a third chamber 36 defined by inner surfaces of the housing 12 and part 21 of the diaphragm 22 and a fourth chamber 38 defined by inner surfaces of the housing 12, the part 23 of the diaphragm 22 as well as dividing wall 24. Then, the element 32 of FIG. 1 has been replaced by two elements 321 and 322, respectively, similar as in FIG. 2.

Electronics 34 may be provided for receiving the outputs of the two vibration sensors and for generating separate outputs. The output originating from the vibration sensor of the first chamber 18 provides a pressure difference i.e. directional signal, whereas the output originating from the vibration sensor of the second chamber 201 provides a pressure i.e. omni-directional signal.

It is noted that the diaphragm 22 is generally not fixed to the dividing wall 24 and thus may move in relation thereto, so that the tension of the parts 21 and 23 may be at least substantially the same. However, it is desired that the chambers 18 and 38 are acoustically separated, or at least that substantially no acoustic signals enter the chamber 38 from the chamber 18 via the dividing wall 24.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A transducer, comprising:

a housing having a dividing portion, a first sound input, and a second sound input;

a first vibration sensor and a second vibration sensor configured to convert vibration to an output;

a diaphragm forming part of both the first and second vibration sensors, a portion of the diaphragm engaging the dividing portion and being movable in relation to the dividing portion;

a first chamber being delimited at least partly by a first part of the housing and a first part of the diaphragm, the first vibration sensor being configured to detect vibration of the first part of the diaphragm, the first sound input into the first chamber; and a second chamber being delimited at least partly by a second part of the housing and a second part of the diaphragm, the second vibration sensor being configured to detect vibration of the second part of the diaphragm, the second sound input into the second chamber.

2. A transducer according to claim 1, wherein the dividing portion of the housing extends between the first and second chambers and forms part of the first and second parts of the housing.

3. A transducer according to claim 2, wherein the dividing portion engages the diaphragm between the first part and the second part of the diaphragm.

4. A transducer according to claim 3, wherein the diaphragm is attached to the dividing portion via a resilient element.

5. A transducer according to claim 3, wherein the diaphragm is biased toward the dividing portion.

6. A transducer according to claim 2, wherein an opening exists between the diaphragm and the dividing portion, the opening having a dimension that permits gas flow.

7. A transducer according to claim 1, wherein the diaphragm is fixed to the housing at least on a first side and a second side of the diaphragm, the first side being fixed at a portion of the first part of the housing, the second side being fixed at a region of the second part of the housing, the first and second parts of the diaphragm being positioned between the first and second sides of the diaphragm.

8. A transducer according to claim 7, the diaphragm being at least substantially rectangular with two shorter sides and two longer sides, the first and second sides being the two shorter sides, the diaphragm being detached from the housing over at least a majority of the length of the longer sides.

9. A transducer according to claim 1, wherein each of the first and second parts of the diaphragm is electrically conducting and wherein the first and second parts of the diaphragm are electrically isolated from each other.

10. A transducer according to claim 9, wherein the first and second vibration sensors comprise an electrically conducting element positioned in the vicinity of the first and second parts of the diaphragm and are configured to output signals corresponding to a distance between the first and second parts, respectively, and the conducting element.

11. A transducer according to claim 9, wherein the first vibration sensor comprises a first electrically conducting element positioned in the vicinity of the first part of the diaphragm and is configured to output a first signal corresponding to a distance between the first part and the first conducting element, and wherein the second vibration sensor comprises a second electrically conducting element positioned in the vicinity of the second part of the diaphragm and is configured to output a second signal corresponding to a distance between the second part and the second conducting element.

12. A transducer according to claim 1, further comprising a third chamber and a fourth chamber, the third chamber being delimited at least partly by a third part of the housing and a surface of the first part of the diaphragm that is opposite to the side of the first part of the diaphragm that partly delimits the first chamber, the fourth chamber being delimited at least partly by a fourth part of the housing and a surface of the second part of the diaphragm that is opposite to the side of the second part of the diaphragm that partly delimits the second chamber.

13. A transducer according to claim 1, further comprising a common chamber delimited at least partly by a surface of the diaphragm that is opposite to a side of the diaphragm that partly defines the first and second chambers.

14. A transducer according to claim 1, wherein the transducer operates as a dual microphone, the first vibration sensor for detecting vibration of the first part of the diaphragm from sounds entering the first sound input, the second vibration sensor for detecting vibration of the second part of the diaphragm from sounds entering the second sound input.

15. A transducer according to claim 1, wherein the transducer operates as a directional microphone, the first vibration sensor for detecting vibration of the first part of the diaphragm from sounds entering the first sound input, the second vibration sensor for detecting vibration of the second part of the diaphragm from sounds entering the second sound input, wherein signals from the first and second vibration sensors are combined and at least one of the signals is time delayed or phase shifted to generate an output signal.

16. A transducer according to claim 1, wherein the diaphragm is monolithic device.

17. A transducer according to claim 16, wherein the diaphragm is a polymeric film, and wherein the first part of the diaphragm includes a first electrically conductive layer and the second part of the diaphragm includes a second electrically conductive layer.

18. A transducer, comprising:

a housing having a first portion, a second portion, and a dividing portion between the first portion and the second portion;

a first conductive element;

a second conductive element;

a single diaphragm positioned in spaced relation to both the first and second conductive elements, a first part of the diaphragm and the first conductive element being part of a first vibration sensor, a second part of the diaphragm and the second conductive element being part of a second vibration sensor, a portion of the diaphragm engaging the dividing portion of the housing and being movable relative to the dividing portion;

a first chamber at least partially defined by the first portion of the housing and the first part of the diaphragm, the first vibration sensor being configured to detect vibration within the first chamber; and a second chamber at least partially defined by the second portion of the housing and the second part of the diaphragm, the second vibration sensor being configured to detect vibration within the second chamber, the second chamber being at least substantially acoustically separated from the first chamber.

19. A transducer according to claim 18, wherein the first conductive element and the second conductive element are part of a common back plate structure.

* * * * *